US005979592A

United States Patent [19]

Delgado

[11] Patent Number: 5,979,592

[45] Date of Patent: Nov. 9, 1999

[54] NOISE DAMPENER FOR A DOOR LOCK FOR A MOTOR VEHICLE DOOR

[75] Inventor: Alfredo Llama Delgado, Santander, Spain

[73] Assignee: Ed. Scharwächter GmbH & Co. KG, Remscheid, Germany

[21] Appl. No.: 09/165,987

[22] Filed: Oct. 2, 1998

[30] Foreign Application Priority Data

Oct. 2, 1997 [DE] Germany ..... 297 17 675 U

[51] Int. Cl.[6] ..... G10K 11/04; E05B 15/02

[52] U.S. Cl. ..... 181/200; 292/341.12; 292/DIG. 56

[58] Field of Search ..... 181/198, 200, 181/201, 202, 205, 207, 208; 292/341.12, DIG. 56

[56] References Cited

U.S. PATENT DOCUMENTS

| | | | |
|---|---|---|---|
| 4,466,645 | 8/1984 | Kobayashi | 292/341.12 |
| 5,785,366 | 7/1998 | Takaishi et al. | 292/341.12 |

*Primary Examiner*—Khanh Dang

*Attorney, Agent, or Firm*—Brown & Wood, LLP

[57] ABSTRACT

A noise dampener for a motor vehicle door lock including a door arrester bar which pivots about an axis extending parallel to a motor vehicle door hinge axis, which is pivotally secured to one of door assembly parts, a door or a door pillar, with a bearing bolt extending through a bearing bore formed in an end region of the door arrester bar and supported in a bearing block, and which extends into a retaining housing secured to another of the door assembly parts and having locking element(s) cooperating with detent marks provided in the door arrester bar for retaining same, with the noise dampener being formed as a hollow part made of a non-metallic, noise dampening material, surrounding, at least partially, the end region of the door arrester bar, and having an interior space closed at least at two sides with the bore having a shape corresponding to a shape of the end region of the door arrester bar and with the hollow part further including a locking nose formed on a wall of the hollow part corresponding to a wide side of the door arrester bar and cooperating with a detent indentation or bore formed in the wide side of the door arrester bar for fixedly securing the hollow part to the door arrester bar.

7 Claims, 1 Drawing Sheet

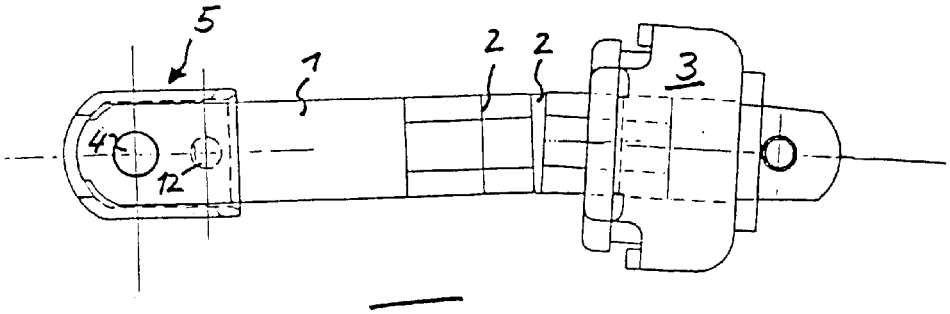
figur 1
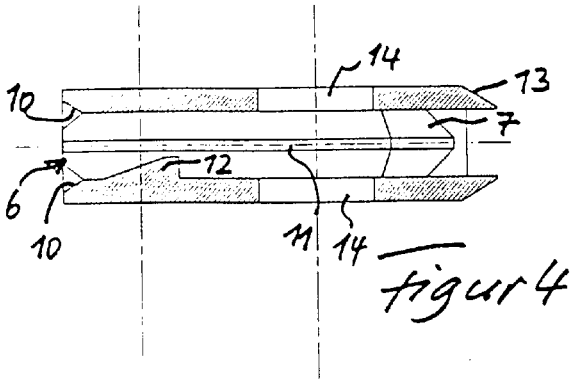
figur 4
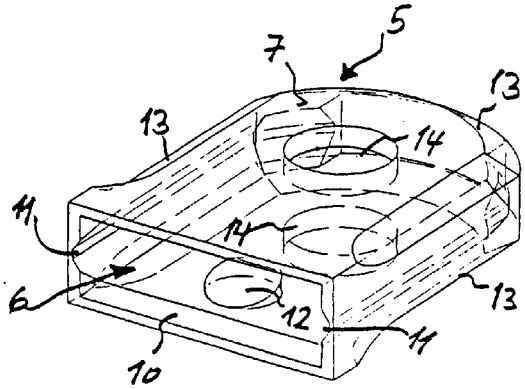
figur 2
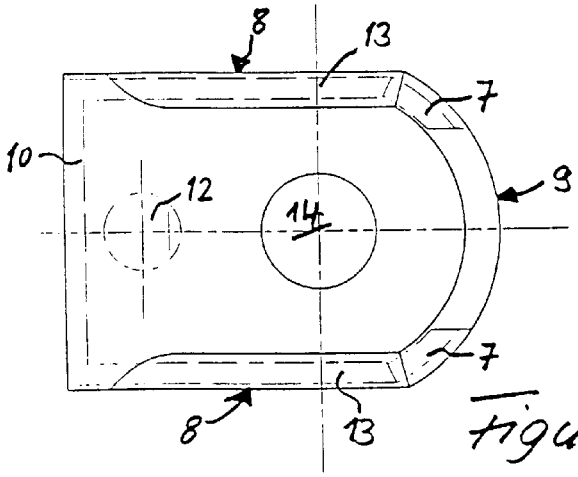
figur 3

NOISE DAMPENER FOR A DOOR LOCK FOR A MOTOR VEHICLE DOOR

BACKGROUND OF THE INVENTION

1. Field of the Invention

The present invention relates to a noise dampener for a motor vehicle door lock including a door arrester bar which pivots about an axis extending parallel to a motor vehicle door hinge axis, which is pivotally secured to one of the door assembly parts, a door or a door pillar, with a bearing bolt extending through a bearing bore formed in an end region of the door arrester bar and supported in a bearing block, and which extends into a retaining housing secured to another of the door assembly parts and having locking means cooperating with detent marks provided in the door arrester bar for retaining same, with the noise dampener being formed of a non-metallic, noise dampening material, surrounding, at least partially, the pivotally securable end region of the door arrester bar, and provided with means for preventing longitudinal displacement of the noise dampener relative to the end region of the door arrester bar.

2. Description of the Prior Art

The door locks of the type described above are locked, during opening or closing of the door, with the door arrester bar which extends into the retaining housing and is secured there with the spring-biased locking means which cooperates with the detent marks provided on the door arrester bar. Thereby, the door can be held in one or more opening positions. Because the door lock parts are mass-produced parts, the discrepancy between the manufacturing tolerances of the bearing bolt for securing the door arrester bar and the bearing bore in which the bearing bolt is received, are inevitable. Because of the possible discrepancy of tolerances, the bearing bolt can extend through the bearing bore either with a relatively large clearance or with a press fit.

When a tolerance discrepancy results in a press fit, it causes difficulties, at least initially, in the attachment of the door arrester bar to the door assembly part. A tolerance discrepancy which results in a clearance fit, leads to that the door arrester bar, which is longitudinally displacable due to cooperation of the locking bodies with the detent marks provided on the door arrester bar, impacts on the bearing bolt causing generation of an unpleasant, undesirable, audible noise.

In order to reduce a possible tolerance discrepancy between the bearing bolt and the bolt-receiving bearing bore, which is formed in the end region of the door arrester bar, and thereby to eliminate or substantially reduce the audible noise resulting from the tolerance discrepancy, German publication DE-OS 40 06 572 suggests to provide a split taper socket, which is formed as a spring sleeve, between the inner wall of the bearing bore and the bearing bolt. Thereby the bearing bolt becomes fixedly secured in the bearing bore, without the possibility of the door arrester bar moving relative thereto. Such a socket permits to eliminate the tolerance discrepancy to a most possible extent, thus eliminating the undesired audible noise. However, the attachment the door arrester bar with the use of a spring socket results in increase of the manufacturing costs. Further, using the split socket results in increase of the assembly time and necessitate use of particular tools.

German Publication DE-OS 37 22 996 suggests for reducing the tolerance discrepancy between the bearing bolt and the bearing bore, to provide a spring element between the bearing block and the door arrester bar, which is formed as a U-shaped snap-on clip pushed onto the end of the door arrester bar and the legs of which have recesses between which the bearing bolt is received. The U-shaped snap-on clip should act as a brake which would prevent the relative movement between the door arrester bar and the bearing bolt in case of an increased clearance, eliminating, theoretically, any audible noise. Because such a snap-on clip should apply an adequate spring force to prevent a relative movement between the door arrester bar and the bearing bolt, it complicates the attachment of the door arrester bar. Further, because such a snap-on clip is made of metal, it cannot dampen or reduce noise which still can be generated by the relative movement between the door arrester bar and the bearing block.

It was further proposed to provide, in the region of the bearing bolt, a fold element formed of a non-metallic material instead of the U-shaped clip, with the fold element having spaced surface portions, which are connected by a connection web, overlap the wide sides of the door arrested bar, and have a through-bore through which the bearing bolt extends. Both free edges of the surface portions are provided with clipping tabs for retaining the free end of the door arrester bar. However, the use of the fold element, which is formed on a non-metallic, in particular, plastic material, does not permit, because of a certain underpressure and a slow braking action, to completely eliminate the relative movement between the door arrester bar and the bearing bolt, in particular when the clearance is relatively large, and thus, to eliminate a possible audible noise. A particular drawback associated with the use of the fold element consists in that it is relatively difficult to mount the fold element onto the end of the door arrester bar and in that the clip tabs, which are provided on the free edges of the surface portions, which overlap the door arrester bar, do not adequately prevent disengagement of the fold element from the door arrester bar.

Accordingly, an object of the present invention is to provide a noise dampener which would reliably prevent any audible noise resulting from displacement of the door arrester bar relative to the bearing bolt.

Another object of the present invention is to provide a noise dampener having a simple construction and which can be easily mounted on the door arrester bar.

SUMMARY OF THE INVENTION

These and other objects of the present invention, which will become apparent hereinafter, are achieved by forming the noise dampener as a hollow part formed of a non-metallic, noise dampening material, surrounding, at least partially the end region of the door arrester bar, and having an interior space closed at least at two of its sides and having a shape corresponding to a shape of the end region of the door arrester bar, with the noise dampener including a locking nose formed on a wall of the hollow part associated with a wide side of the door arrester bar, and cooperating with a detent element formed in the wide side of the door arrester bar for fixedly securing the hollow part to the door arrester bar in a longitudinal direction of the door arrester bar.

Forming the noise dampener as a hollow part which, on one hand limits or arrests the movement of the door arrester bar and, on the other hand dampens the noise generated by the movement of the door arrester bar relative to the bearing bolt, and which has an interior space corresponding to the shape of the end region of the door arrester bar, substantially facilitate mounting of the inventive noise dampener on the door arrester bar, as it can simply be pushed onto the end region of the door arrester bar. Furthermore, an inadvertent automatic disengagement of the noise dampener is prevented. Still further, forming the noise dampener as a hollow part permits to form the hollow part from relatively light, elastic plastic material having increased noise dampening characteristics.

In a preferred embodiment of the present invention, the hollow part has an entrance opening a cross-section of which corresponds to a cross-section of the door arrester bar. The hollow part further has, at its end opposite to the entrance opening, two wall section extending transverse to a longitudinal extent of the hollow part and forming interlocking elements limiting advance of the door arrested bar.

According to a further development of the present invention, at least the longitudinal walls of the hollow part can be provided with outwardly extending grooves.

According to an advantageous embodiment of the noise dampener according to the present invention, the hollow part has, at its end opposite to the entrance opening, a bulged profile, and the interlocking means-forming wall sections adjoin respective longitudinal side walls of the hollow part and extend along a portion of the end surface of the hollow part, with the portion of the end surface between the wall portions remaining open.

In order to eliminate any problem in mounting of the noise dampener on the door arrester bar and to insure a wear-free engagement of the hollow part between the bearing block arms, the hollow part is provided, at least in the region of its overlapping with the door arrester bar, with chamfered circumferential edges adapted to cooperate with the bearing arms of the bearing bolt.

BRIEF DESCRIPTION OF THE DRAWINGS

The features and objects of the present invention will become more apparent, and the invention itself will be best understood from the following detailed description of the preferred embodiment when read with reference to the accompanying drawings, wherein:

FIG. 1 shows schematically a plan view of a motor vehicle door lock with a noise dampener according to the present invention;

FIG. 2 shows a perspective view of a noise dampener for the door lock shown in FIG. 1;

FIG. 3 shows a plan view of the noise dampener shown in FIG. 2; and

FIG. 4 shows a longitudinal cross-sectional view of the noise dampener shown in FIGS. 2 and 3.

DETAILED DESCRIPTION OF THE PREFERRED EMBODIMENTS

In a motor vehicle door lock, the schematic plan view of which is shown in FIG. 1, a door arrester bar 1, which pivots about an axis extending parallel to the hinge axis of the motor vehicle door, is secured to one of door assembly parts, a door or a door pillar, not shown in the drawings. The door arrester bar 1 is provided with locking or retaining marks 2 and extends into a retaining housing 3 which is secured to another part of the door assembly. The retaining housing 3 contains spring-biased braking and locking means cooperating with the detent marks 2. The door arrester bar 1 is pivotally secured to the respective one door assembly part with a bearing bolt, not shown in the drawings, which extends through a bearing bore 4 formed in the end region of the door arrester bar 1, with the bearing bolt being arranged in a bearing block, likewise not shown in the drawings. In the region of its attachment (bearing bore 4) the door arrester bar 1 is provided with a noise dampener 5 according to the present invention. The noise dampener 5 is formed of a non-metallic, noise dampening plastic material and is formed as a hollow part which receives the end of the door arrester bar 1 and encompasses the bearing bore 4. The noise dampener 5 has an entrance opening 6 the cross-section of which corresponds to the cross-section of the door arrester bar 1, and has wall sections 7 which are located opposite the entrance opening 6, extend transverse to the longitudinal extent of the noise dampener 5, and form interlocking means limiting the advance of the door arrester bar 1. The noise dampener 5 further has a through-bore 14 which extends through the wall region of the noise dampener 5 which overlap the wide sides of the door arrester bar 1. The through-bore 14 is congruent with the bearing bore 4 and is adapted to receive the bearing bolt.

In the embodiment of the noise dampener 5, shown in the drawings, the region of the noise dampener 5 opposite the entrance opening 6 has a profile, preferably a bulging profile, corresponding to the end of profile of the door arrester bar 1, and the interlocking wall sections 7 adjoin respective opposite longitudinal walls 8 of the noise dampener 5. The wall sections 7 extend along a portion of the end surface 9 of the noise dampener 5. The entrance opening 6 has an entry chamfer 10. Inner surfaces of the longitudinal walls 8 are provided with outwardly directed grooves 11, respectively. For its attachment to the door arrester bar 1, the noise dampener 5 is provided with inwardly extending locking nose 12 which is formed on one of the wide side wall and the inclination surface of which corresponds to the inclination of the chamfer 10. The locking nose 12 cooperates with a complementary locking indentation formed in the door arrester bar 1. For mounting the noise dampener 5 between two bearing arms of the bearing block, the noise dampener 5, i.e., the hollow part, which forms the noise dampener, has in its region overlapping the door arrester bar 1, chamfered edges 13 cooperating with one or both bearing arms of the bearing block.

Though the present invention was shown and described with references to the preferred embodiments, various modifications thereof will be apparent to those skilled in the art and, therefore, it is not intended that the invention be limited to the disclosed embodiment or details thereof, and departure can be made therefrom within the spirit and scope of the appended claims.

What is claimed is:

1. A noise dampener for a motor vehicle door lock including a door arrester bar which pivots about an axis extending parallel to a motor vehicle door hinge axis, which is pivotally secured to one of door assembly parts, a door or a door pillar, with the bearing bolt extending through a bearing bore formed in an end region of the door arrester bar and supported in a bearing block, and which extends into a retaining housing secured to another of the door assembly parts and having locking means cooperating with detend marks provided in the door arrester bar for retaining same, the noise dampener comprising:

a hollow part formed of a non-metallic, noise dampening material surrounding, at least partially, the end region of the door arrester bar, and having an interior space closed at least at two sides thereof with a shape corresponding to a shape of the end region of the door arrester bar; and a locking nose formed on a wall of the hollow part associated with a wide side of the door arrester bar and cooperating with detent means formed in the wide side of the door arrester bar for fixedly securing the hollow part to the door arrester bar.

2. A noise dampener as set forth in claim 1, wherein the hollow part has an entrance opening a cross-section of which corresponds to a cross-section of the door arrester bar.

3. A noise dampener as set forth in claim 2, wherein the hollow part has, at an end thereof opposite to the entrance opening, two wall sections extending transverse to a longitudinal extent of the hollow part and forming interlocking means limiting advance of the door arrester bar.

4. A noise dampener as set forth in claim 1, wherein the hollow part has, at least in a region where it overlaps the door arrester bar, chamfered circumferential edges cooperating with at least one of bearing arms of the bearing block in which the bearing bolt is supported.

5. A noise dampener as set forth in claim 1, wherein at least longitudinal walls of the hollow part are provided on inner surfaces thereof with outwardly extending grooves.

6. A noise dampener as set forth in claim 2, wherein the hollow part has an entry chamfer at the entrance opening.

7. A noise dampener as set forth in claim 3, wherein the hollow part has, at an end thereof opposite to the entrance opening, a bulging profile, and wherein the interlocking means-forming wall sections adjoin longitudinal side walls of the hollow part and extend along a portion of an end surface of the hollow part.

* * * * *